US010801437B2

(12) United States Patent
Hopf et al.

(10) Patent No.: US 10,801,437 B2
(45) Date of Patent: Oct. 13, 2020

(54) LIQUID-COOLED INTERNAL COMBUSTION ENGINE

(71) Applicant: Ford Global Technologies, LLC, Dearborn, MI (US)

(72) Inventors: Anselm Hopf, Baesweiler (DE); Klaus-Peter Heinig, Aachen (DE); Wilbert Hemink, Landgraaf (NL); Hans Guenter Quix, Herzogenrath (DE); Bas van den Heuvel, Wijnandsrade (NL); Franz Weber, Waldorf (DE)

(73) Assignee: Ford Global Technologies, LLC, Dearborn, MI (US)

( * ) Notice: Subject to any disclaimer, the term of this patent is extended or adjusted under 35 U.S.C. 154(b) by 140 days.

(21) Appl. No.: 15/886,760

(22) Filed: Feb. 1, 2018

(65) Prior Publication Data

US 2018/0230934 A1 Aug. 16, 2018

(30) Foreign Application Priority Data

Feb. 10, 2017 (DE) ..... 10 2017 202 154

(51) Int. Cl.
*F02F 1/10* (2006.01)
*F01P 3/02* (2006.01)
(Continued)

(52) U.S. Cl.
CPC *F02F 1/10* (2013.01); *F01P 3/02* (2013.01); *F01P 5/10* (2013.01); *F01P 11/04* (2013.01);
(Continued)

(58) Field of Classification Search
CPC ..... F02F 1/10; F02F 1/36; F01P 3/02; F01P 5/10; F01P 11/04; F01P 2003/024
See application file for complete search history.

(56) References Cited

U.S. PATENT DOCUMENTS 1,765,230 A * 6/1930 Guernsey ..... F01P 3/20 123/41.32
6,481,392 B1 * 11/2002 Etemad ..... F02F 1/108 123/41.74
(Continued)

FOREIGN PATENT DOCUMENTS

DE 102009023530 A1 12/2010
DE 102013203476 A1 9/2014

*Primary Examiner* — Syed O Hasan
(74) *Attorney, Agent, or Firm* — Geoffrey Brumbaugh; McCoy Russell LLP

(57) ABSTRACT

An internal combustion engine with coolant jackets is provided. The internal combustion engine includes a cylinder head coupled to a cylinder block to form a first cylinder, an upper head-associated coolant jacket including a coolant conduit traversing the cylinder head, a lower head-associated coolant jacket fluidly separated from the upper cylinder head coolant jacket and including a coolant conduit traversing the cylinder head vertically below the upper head-associated coolant jacket, and a block-associated coolant jacket including, a first coolant passage having an inlet in fluidic communication with a coolant pump outlet and an outlet in fluidic communication with an inlet of the lower head-associated coolant jacket, and a second coolant passage having an inlet in fluidic communication with an outlet of the lower head-associated coolant jacket and an outlet in fluidic communication with a heat exchanger.

20 Claims, 3 Drawing Sheets

(51) Int. Cl.

| | |
|---|---|
| ***F01P 11/04*** | (2006.01) |
| ***F01P 5/10*** | (2006.01) |
| *F02F 1/36* | (2006.01) |

(52) U.S. Cl.
CPC ... *F01P 2003/024* (2013.01); *F01P 2003/027* (2013.01); *F02F 1/36* (2013.01)

(56) References Cited

U.S. PATENT DOCUMENTS

| | | | | |
|---|---|---|---|---|
| 9,429,063 | B2 | 8/2016 | Youm et al. | |
| 9,500,115 | B2 | 11/2016 | Quix et al. | |
| 10,030,571 | B2 * | 7/2018 | Yi | F02F 1/004 |
| 2014/0245975 | A1 | 9/2014 | Quix et al. | |
| 2016/0201548 | A1 * | 7/2016 | Moscherosch | F01P 7/162 123/41.02 |

* cited by examiner

LIQUID-COOLED INTERNAL COMBUSTION ENGINE

CROSS REFERENCE TO RELATED APPLICATION

The present application claims priority to German Application No. 102017202154.3, filed on Feb. 10, 2017. The entire contents of the above-referenced application are hereby incorporated by reference in its entirety for all purposes.

FIELD

This disclosure relates to an internal combustion engine having a liquid-cooled cylinder head and a liquid-cooled cylinder block.

BACKGROUND/SUMMARY

Liquid cooling systems have been used in engines to dissipate heat generated during engine combustion. German Patent Application DE 10 2014 201 717 A1 describes a liquid-cooled internal combustion engine with a liquid-cooled cylinder head and a liquid-cooled cylinder block, in which internal combustion engine the block-associated coolant jacket is supplied with coolant via a supply opening which is provided in the cylinder block, and a head-associated coolant jacket which faces the cylinder block is supplied via connecting ducts with coolant which originates from the cylinder block, wherein the coolant exits this head-associated coolant jacket via a discharge opening which is provided in the cylinder head. In the engine, a second coolant jacket is integrated in the cylinder head on the side of the exhaust gas lines, which faces away from the cylinder block and said coolant jacket has a separate coolant supply.

A disadvantage with the cooling concept described in DE 10 2014 201 717 A1 is that a comparatively large pressure gradient is built up over the integrated coolant jackets, i.e., between the supply opening in the cylinder block and the discharge opening in the cylinder head. This pressure gradient has multiple causes and results essentially from the way in which the flow passes through the cylinder block and the cylinder head.

Against this background, an internal combustion engine is provided to overcome at least some of the aforementioned problems. The internal combustion engine includes a cylinder head coupled to a cylinder block to form a first cylinder, an upper head-associated coolant jacket including a coolant conduit traversing the cylinder head, a lower head-associated coolant jacket fluidly separated from the upper head-associated coolant jacket and including a coolant conduit traversing the cylinder head vertically below the upper head-associated coolant jacket. The internal combustion engine also includes a block-associated coolant jacket including, a first coolant passage having an inlet in fluidic communication with a coolant pump outlet and an outlet in fluidic communication with an inlet of the lower head-associated coolant jacket, and a second coolant passage having an inlet in fluidic communication with an outlet of the lower head-associated coolant jacket and an outlet in fluidic communication with a heat exchanger. In this way, the coolant jackets enable coolant to flow from the cylinder block into the cylinder head and then back into the cylinder block in engine locations that are adjacent to the cylinder. This type of coolant jacket flow pattern enables a greater amount of heat to be removed from the engine when compared to previous engine cooling systems. As a result, the engine's combustion efficiency can be increased while reducing emissions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 3 is shown approximately to scale. However, other relative dimensions may be used in other embodiments.

DETAILED DESCRIPTION

Figure 1:
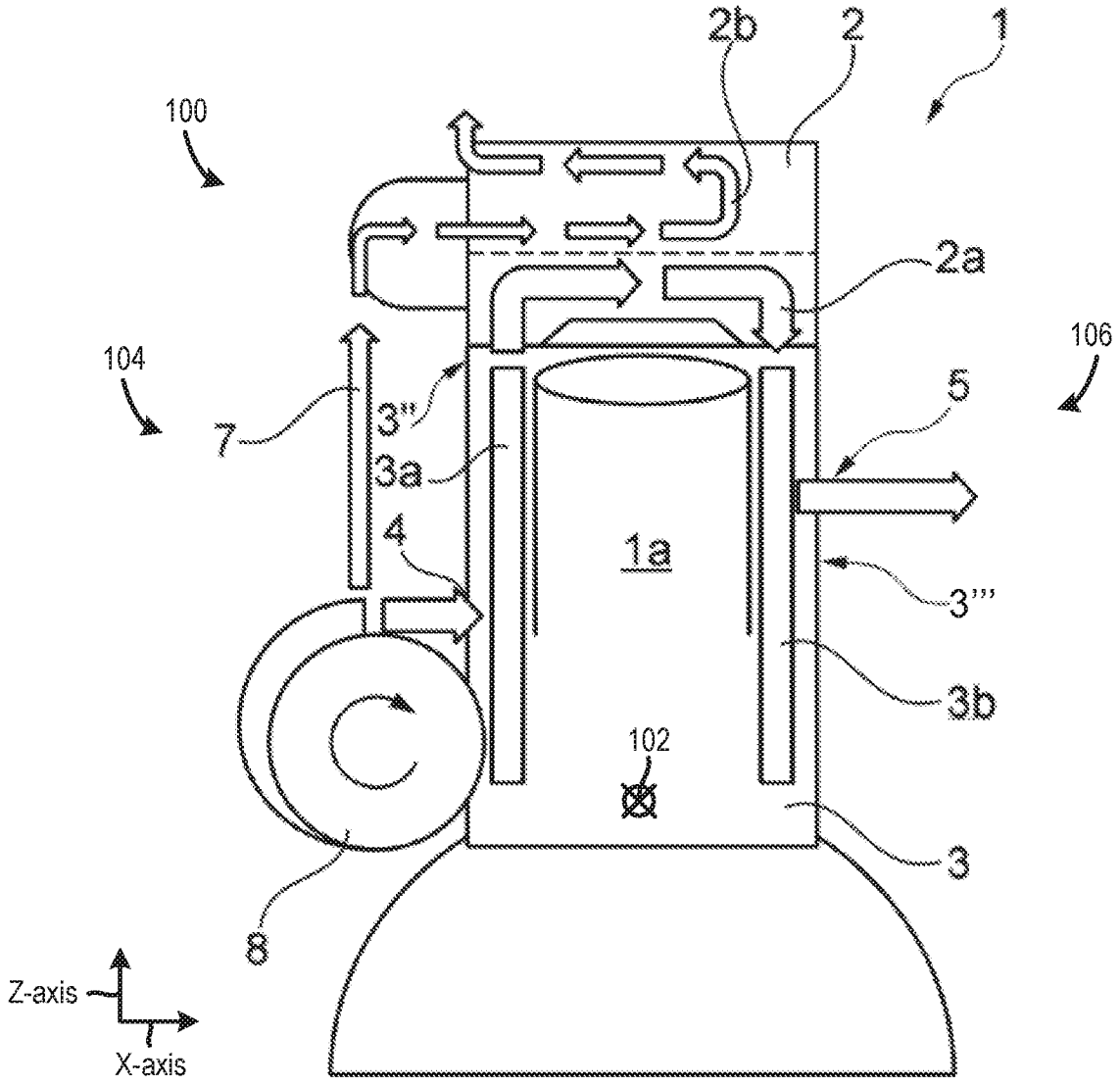
FIG. 1 shows an illustration of an internal combustion engine in a side view illustrating the general concept of the liquid cooling system within the engine.

In previous engine cooling systems, such as in German Patent Application DE 10 2014 201 717, coolant has to travel along long flow paths and pass through tight flow cross-sections between the supply opening in the cylinder block and the discharge opening in the cylinder head. The coolant in particular has to change or flow from the inlet side to the outlet side between adjacent cylinders via narrow passages in the cylinder block. The inlet side is the side from which the internal combustion engine is supplied with combustion air, and the outlet side is the side from which the exhaust gases are discharged. The flow through the cylinder head is essentially in the direction of the longitudinal axis and as a result, the main flow direction is constituted in the head. This is caused by the fact that the coolant is provided with just one discharge opening on the short end side of the cylinder head in order to exit the coolant jackets or the cylinder head, and the supply opening and the discharge opening are provided on opposite end sides of the combination of the cylinder block and cylinder head. The main flow direction in the head or the large pressure gradient bring about a situation in which the connecting ducts between the block-associated coolant jacket and the head-associated coolant jacket have to be provided with an increasingly large diameter in the main flow direction, so that the coolant throughput rate of each cylinder or the cylinder-specific cooling capacity are approximated despite a reduction in pressure in the main flow direction.

To resolve at least some of the problems with previous engine cooling systems, an internal combustion engine having a liquid-cooled cylinder head and a liquid-cooled cylinder block coupled to form a cylinder is described herein. The cylinder in the internal combustion engine may have on the inlet side at least one inlet opening for supplying combustion air via an intake system and on the outlet side at least one outlet opening for discharging the exhaust gases via an exhaust-gas discharge system. In the engine the cylinder block may be equipped with at least two integrated coolant jackets, wherein a first block-associated coolant jacket is provided on the outlet side and has a supply opening for supplying coolant, and a second block-associated coolant jacket is provided on the inlet side and has a discharge opening for discharging the coolant. Additionally, the cylinder head may be equipped with at least one integrated coolant jacket, wherein at least one head-associated coolant jacket can at least be connected to the first block-associated coolant jacket for the purpose of supplying coolant and to the second block-associated coolant jacket for the purpose of discharging coolant. Furthermore, in the engine, the first block-associated coolant jacket and the second block-associated coolant jacket may be each embodied integrally in the cylinder block, and the first block-associated coolant jacket and the second block-associated coolant jacket of a cylinder block blank may be embodied as coolant jackets that are fluidically separated from one another.

An internal combustion engine of the above-stated type may be used as a drive for motor vehicles. Within the context of the present description, the expression "internal combustion engine" encompasses spark-ignition engines, diesel engines, and also hybrid internal combustion engines, which utilize a hybrid combustion process, and also hybrid drives which include not only the internal combustion engine but also an electric machine which can be connected in terms of drive to the internal combustion engine and which receive power from the internal combustion engine or which, as a switchable auxiliary drive, additionally output power.

Internal combustion engines have a cylinder block and at least one cylinder head that can be connected to one another or are connected to one another in order to form the individual cylinders, that is to say combustion chambers. The individual components will be discussed briefly below.

The cylinder head may serve to hold the control elements, and in the case of an overhead camshaft, to hold the valve drives in their entirety. During the charge exchange, the combustion gases may be discharged via the at least one outlet opening and the charging of the combustion chamber takes place via the at least one inlet opening of the at least one cylinder. To control the charge exchange, in four-stroke engines, use may be made (e.g., almost exclusively made) of lifting valves as control elements, which lifting valves perform an oscillating lifting movement during the operation of the internal combustion engine and which lifting valves open and close the inlet opening and outlet opening in this way. The valve actuating mechanism required for the movement of a valve, including the valve itself, is referred to as the valve drive.

In external-ignition internal combustion engines, an ignition device may also be arranged in the cylinder head, as can the injection device in the case of direct-injection internal combustion engines, and in the case of diesel engines, if appropriate, a glow plug may be arranged in the cylinder head. To form a functional connection, which seals off the combustion chambers, of cylinder head and cylinder block, an adequately large number of adequately large bores may be provided, in one example.

To hold the pistons or the cylinder liners, the cylinder block may have a corresponding number of cylinder bores. The piston of each cylinder of an internal combustion engine may be guided in an axially movable manner along the longitudinal axis in a cylinder barrel and, together with the cylinder barrel and the cylinder head, delimit the combustion chamber of a cylinder, in one example. Here, the piston crown may form a part of the combustion chamber inner wall, and, together with the piston rings, may seal off the combustion chamber with respect to the cylinder block or the crankcase, such that no combustion gases or no combustion air passes into the crankcase, and no oil passes into the combustion chamber, in one example.

The pistons may serve to transmit the gas forces generated by the combustion to the crankshaft. For this purpose, each piston may be articulatedly connected to a connecting rod via a piston pin, which in turn is movably mounted on the crankshaft.

In one example, the crankshaft that is mounted in the crankcase may absorb the connecting rod forces, which are composed of the gas forces as a result of the fuel combustion in the combustion chamber and the inertia forces as a result of the non-uniform movement of the engine parts. Here, the oscillating reciprocating movement of the pistons is transformed into a rotational movement of the crankshaft. The crankshaft may transmit the torque to the drivetrain. A part of the energy transmitted to the crankshaft may be used for driving auxiliary units such as the oil pump, coolant pump or water pump, and the alternator, or serves for driving the camshaft and therefore for actuating the valve drives, in one example.

It may be possible for the cooling arrangement of an internal combustion engine to take the form of an air-type cooling arrangement or a liquid-type cooling arrangement. On account of the higher heat capacity of liquids, it may be possible for significantly greater quantities of heat to be dissipated using a liquid-type cooling arrangement than is possible using an air-type cooling arrangement. Therefore, internal combustion engines may be ever more frequently being equipped with a liquid-type cooling arrangement, because the thermal loading of the engines is constantly increasing.

Another reason for this is that internal combustion engines are increasingly being supercharged and—with the aim of obtaining dense packaging—an ever greater number of components are being integrated into the cylinder head or cylinder block, as a result of which the thermal loading of the engines, that is to say of the internal combustion engines, is increasing. The exhaust manifold is commonly integrated into the cylinder head in order to be incorporated into a cooling arrangement provided in the cylinder head and in order that the manifold need not be produced from thermally highly loadable materials, which are expensive.

A liquid-type cooling arrangement may include a cylinder head equipped with at least one coolant jacket that includes coolant ducts which conduct the coolant through the cylinder head. The at least one coolant jacket may be supplied with coolant via a supply opening, which coolant, after flowing through the cylinder head, exits the coolant jacket via a discharge opening. The heat need not first be conducted to the cylinder head outer surface in order to be dissipated, as is the case in an air-type cooling arrangement, but rather is discharged to the coolant in the interior of the cylinder head. Here, the coolant may be delivered via a pump arranged in the coolant circuit, such that said coolant circulates. The heat which is discharged to the coolant may thereby be discharged from the interior of the cylinder head, and may be extracted from the coolant again outside the cylinder head, for example by means of a heat exchanger and/or in some other way.

Like the cylinder head, the cylinder block may also be equipped with one or more coolant jackets. The cylinder head may be the thermally more highly loaded component because, in contrast to the cylinder block, the head may be provided with exhaust-gas-conducting lines, and the combustion chamber walls that are integrated in the head may be exposed to hot exhaust gas for longer than the cylinder barrels provided in the cylinder block. Furthermore, the cylinder head may have a lower component mass than the block, in some examples.

As coolant, use may be made of a water-glycol mixture provided with additives. In relation to other coolants, water has the advantage that it is non-toxic, readily available and cheap, and furthermore has a very high heat capacity, for which reason water is suitable for the extraction and dissipation of very large amounts of heat, which is considered to be advantageous.

The internal combustion engine described herein may be liquid-cooled and may have at least one liquid-cooled cylinder head and liquid-cooled cylinder block.

To form a coolant circuit, the discharge opening from which the coolant is discharged can at least be connected to the supply opening that serves for the supply of coolant to the coolant jackets, for which purpose a line or multiple lines may be provided. These lines need not be lines in the actual sense but rather may also be integrated in certain sections into the cylinder head, the cylinder block or some other component. An example of such a line is a recirculation line in which a heat exchanger is arranged in order to extract heat from the coolant. Within the scope of the present description, "can at least be connected" means that the discharge opening is either permanently connected to the supply opening via a line system, or can be connected to one another in targeted fashion through the use of valves and/or shut-off elements.

The internal combustion engine described herein has a liquid-cooled cylinder head and a liquid-cooled cylinder block, wherein a coolant jacket which is integrated in the cylinder head is or can be connected via connecting ducts to at least two coolant jackets integrated into the cylinder block, in one example.

In particular, the coolant jacket that is integrated into the cylinder head may be supplied, via a first block-associated coolant jacket arranged on the outlet side, with coolant originating from the cylinder block. The coolant flows through the coolant jacket integrated into the cylinder head, transversely with respect to the longitudinal axis of the cylinder head from the outlet side to the inlet side, and exits the cylinder head on the inlet side, wherein the coolant is discharged into a second block-associated coolant jacket which is arranged on the inlet side.

The main flow direction of the coolant in the head therefore may run transversely with respect to the longitudinal axis of the cylinder head, as result of which extremely short flow paths are produced for the coolant in the cylinder head. The coolant flows, driven by the pressure gradient between the first block-associated coolant jacket and the second block-associated coolant jacket, from the thermally more highly stressed, hotter outlet side to the thermally less stressed, less hot inlet side. In this context, the coolant flows over the thermally highly stressed region of the cylinder head, in particular the region facing the block, which also forms combustion chambers and are impacted by hot exhaust gases. Convection ensures that heat is effectively discharged from these thermally highly stressed regions of the cylinder head, wherein the flow rate and therefore the discharge of heat caused by convection can be influenced via the flow cross-sections that are made available.

Resulting from the fact that the main flow direction of the coolant in the cylinder head runs transversely with respect to the longitudinal axis of the cylinder head, there may be virtually no pressure gradient or loss of pressure along the longitudinal axis of the cylinder head. Providing the connecting ducts between the block-associated coolant jacket and the head-associated coolant jacket with specific diameters of different sizes, i.e., of having to design them to compensate the cooling of the individual cylinders, i.e., to calibrate the cylinder-specific cooling capacity, may be dispensed with, in one example, if desired.

In another example, the coolant in the cylinder block does not have to flow from the inlet side to the outlet side in order to supply coolant to the coolant jacket integrated into the cylinder head. In another example, the first block-associated coolant jacket which is arranged on the outlet side does not have to be connected, as in the prior art, to the second block-associated coolant jacket by means of narrow passages provided in the cylinder block, said coolant jacket being arranged on the inlet side, in some examples. In another example, the two block-associated coolant jackets are connected to one another via a cylinder head, i.e., via a cylinder head-associated coolant jacket, wherein the first block-associated coolant jacket which is provided on the outlet side has a supply opening for supplying coolant, and the second block-associated coolant jacket which is provided on the inlet side is equipped with a discharge opening for discharging the coolant.

The pressure gradient, known from the prior art, in the cylinder block, which results from the use of narrow passages and from the need to transport or feed the coolant from the inlet side to the outlet side in the cylinder block, may be dispensed with, if desired.

According to one embodiment, ducts of the type described above can also be made in the cylinder block of the internal combustion engine described herein, which ducts connect the first block-associated coolant jacket to the second block-associated coolant jacket. However, within the scope of the present description these ducts have a different function or a different purpose and do not necessarily have to be provided, in some examples.

The low pressure gradient between the supply opening and the discharge opening may require a pumping capacity which is smaller compared to the prior art, in order to feed the coolant and allow it to circulate in the coolant circuit, in some examples. This permits the use of an electrically operated pump which can advantageously be controlled in a variable fashion, with the result that the coolant throughput rate or feed pressure can be influenced or set according to demand, in one example.

Further, in one example, the internal combustion engine may increase (e.g., optimize) the amount of heat removed by the engine cooling system.

Since the cylinder block described herein may be equipped with at least two integrated coolant jackets, two or three or more block-associated coolant jackets, which each have a separate supply opening for supplying coolant, can also be provided on the outlet site. On the inlet side it is also possible to provide two or three or more block-associated coolant jackets which each have a separate discharge opening for discharging the coolant.

In one example, two or more supply openings may be supplied with coolant via a common distributor, and/or two or more discharge openings can open into a common discharge line or collecting line.

In one example, the flow direction of the block and head do not have to run, or be formed, from the supply opening to the discharge opening, but instead can also run, or be formed, from the discharge opening to the supply opening. In the last-mentioned concept, the supply opening becomes the discharge opening, and the discharge opening becomes the supply opening.

The internal combustion engine described herein may be equipped with a supercharging arrangement. A liquid-type cooling arrangement has proven to be advantageous in particular in the case of supercharged engines because the thermal loading of supercharged engines is considerably higher than that of conventional internal combustion engines.

Supercharging serves primarily to increase the power of the internal combustion engine. Here, the air needed for the combustion process is compressed, as a result of which a greater air mass can be supplied to each cylinder per working cycle. In this way, the fuel mass and therefore the mean pressure can be increased.

Supercharging is a suitable way for increasing the power of an internal combustion engine while maintaining an unchanged swept volume, or for reducing the swept volume while maintaining the same power. In all cases, supercharging leads to an increase in volumetric power output and a more expedient power-to-weight ratio. If the swept volume is reduced, it is possible, given the same vehicle boundary conditions, to shift the load collective toward higher loads, at which the specific fuel consumption is lower. Supercharging consequently assists in the constant efforts in the development of internal combustion engines to reduce (e.g., minimize) fuel consumption, that is to say to improve the efficiency of the internal combustion engine.

By means of a suitable transmission configuration, it is additionally possible to realize so-called downspeeding, whereby a lower specific fuel consumption is likewise achieved. In the case of downspeeding, use is made of the fact that the specific fuel consumption at low engine speeds is generally lower, in particular in the presence of relatively high loads.

With the supercharged engine, it is also possible to obtain advantages with regard to the exhaust-gas emissions. With suitable supercharging for example of a diesel engine, the nitrogen oxide emissions can therefore be reduced without any losses in efficiency, for instance. At the same time, the hydrocarbon emissions can be positively influenced. The emissions of carbon dioxide, which correlate directly with fuel consumption, likewise decrease with falling fuel consumption.

For supercharging, use may be made of an exhaust-gas turbocharger, in which a compressor and a turbine are arranged on the same shaft. In the turbocharger the hot exhaust-gas flow is fed to the turbine and expands in the turbine with a release of energy, as a result of which the shaft is set in rotation. The energy transferred from the exhaust-gas flow to the turbine and ultimately to the shaft is used for driving the compressor which is likewise arranged on the shaft. The compressor conveys and compresses the charge air fed to it, as a result of which supercharging of the cylinders is achieved. A charge-air cooler may be advantageously provided in the intake system downstream of the compressor. The compressed charge air is cooled before it enters the cylinders via the charge-air cooler. The cooler lowers the temperature and thereby increases the density of the charge air, such that the cooler also contributes to improved charging of the cylinders, that is to say to a greater air mass. In this way, compression by cooling takes place.

The advantage of an exhaust-gas turbocharger in relation to a supercharger, which is driven by an auxiliary drive, is that an exhaust-gas turbocharger utilizes the exhaust-gas energy of the hot exhaust gases. On the other hand, a supercharger draws energy directly or indirectly from the internal combustion engine and thus adversely affects, that is to say reduces, the efficiency, at least for as long as the drive energy does not originate from an energy recovery source.

If the supercharger is not one that can be driven by an electric machine, that is to say electrically, a mechanical or kinematic connection for power transmission may be generally needed between the supercharger and the internal combustion engine, that also may adversely affect the packaging in the engine bay.

The advantage of a supercharger in relation to an exhaust-gas turbocharger is that the supercharger can generate, and make available, the desired charge pressure at all times, specifically virtually with little delay and regardless of the operating state of the internal combustion engine. This applies in particular to a supercharger which can be driven electrically by means of an electric machine, and is therefore independent of the rotational speed of the crankshaft.

In previous engines, difficulties have arisen when trying to achieve an increase in power in all engine speed ranges, and in particular without a delay, by means of exhaust-gas turbocharging. A relatively severe torque drop has been encountered when a certain engine speed is undershot. Said torque drop may be understandable if one takes into consideration that the charge pressure ratio is dependent on the turbine pressure ratio or the turbine power. If the engine speed is reduced, this leads to a smaller exhaust-gas mass flow and therefore to a lower turbine pressure ratio or a lower turbine power. Consequently, toward lower engine speeds, the charge pressure ratio likewise decreases. This equates to a torque drop.

Further advantageous embodiments of the supercharged, liquid-cooled internal combustion engine are explained herein.

Embodiments of the supercharged liquid-cooled internal combustion engine in which the discharge opening can at least be connected to the supply opening in order to form a coolant circuit may also be advantageous.

Embodiments of the supercharged, liquid-cooled internal combustion engine in which an electrically powered pump is arranged in the coolant circuit may also be advantageous. With respect to the advantages, reference is made to the statements already made above.

Embodiments of the supercharged, liquid-cooled internal combustion engine in which the first block-associated coolant jacket and the second block-associated coolant jacket are fluidically connected to one another via at least one duct, formed in the cylinder block blank, may also be advantageous.

Referring to the cylinder block blank in the present case is intended to express the fact that the first block-associated coolant jacket and the second block-associated coolant jacket of the cylinder block blank are originally separated from one another. It is intended to emphasize that ducts of the type in question are not formed together with the coolant jackets within the scope of a common fabrication method.

In a cylinder block which is manufactured using a casting method, although the coolant jackets are formed in one piece with the rest of the cylinder block within the scope of the casting, no ducts which connect the coolant jackets are formed, e.g., cast.

In a cylinder block which is manufactured using an additive fabrication method (e.g., 3D printing), and which is constructed in a layered fashion, although the coolant jackets are formed in one piece with the rest of the cylinder block within the scope of the construction process, no ducts which connect the coolant jackets are formed (e.g., cast), in one example.

Ducts of the type in question, which fluidically connect the first block-associated coolant jacket to the second block-associated coolant jacket to one another in the interior of the cylinder block, may be introduced, e.g., formed for example by means of drilling or sawing, subsequently and within the scope of post-processing of the cylinder block blank.

In this context, embodiments of the supercharged liquid-cooled internal combustion engine may therefore also be advantageous in which at least one duct is a machined duct, e.g. by drilling or sawing. The ducts that fluidically connect the first block-associated coolant jacket to the second block-associated coolant jacket in the interior of the cylinder block, may not serve the purpose of feeding coolant from the outlet side to the inlet side or from the inlet side to the outlet side, in one example.

In some examples, in multi-cylinder internal combustion engines the ducts may cool the thermally highly stressed web regions between two adjacent cylinders.

In supercharged, liquid-cooled internal combustion engines with two or more cylinders, embodiments may also be advantageous where at least one duct is arranged between two adjacent cylinders.

However, embodiments in which such a duct is arranged between an external cylinder and a side wall which bounds the cylinder block on the outside can also be advantageous.

In supercharged liquid-cooled internal combustion engines with ducts of the type in question, embodiments are advantageous in which the at least one duct has a maximum diameter $d_{k,max}$ where $d_{k,max} \leq 5$ mm (e.g., where $d_{k,max} \leq 4$ mm or where $d_{k,max} \leq 3.5$ mm) or a maximum saw kerf width $s_{k,max}$ where $s_{k,max} \leq 4$ mm.

As already described, a duct of the type in question may not serve to transport coolant from the outlet side to the inlet side in the actual sense. However, the ducts can serve to reduce the coolant flow rate through the cylinder head. The ducts can also serve to set (e.g., calibrate) the coolant flow rate by suitable sizing the diameter of the ducts because the coolant flow directed through the cylinder head may be decreased by the amount of coolant that is fed from the outlet side to the inlet side in the block via the ducts by bypassing the cylinder head.

In supercharged internal combustion engines having at least two cylinders which are arranged along a longitudinal axis of the cylinder block, embodiments can be advantageous where a side wall of the cylinder block is arranged on the inlet side the discharge opening. In such an example, the side wall may be oriented along the longitudinal axis of the cylinder block.

In the cooling system described herein, the coolant is located or collects on the inlet side after flowing through the cylinder block and the cylinder head. Thus in the cooling system it may be advantageous to arrange the discharge opening on the inlet side, for example on the inlet side in a side wall of the cylinder block. In such an example, the side wall may be oriented along the longitudinal axis of the cylinder block.

In supercharged internal combustion engines having at least two cylinders which are arranged along a longitudinal axis of the cylinder block, embodiments can also be advantageous where a side wall of the cylinder block is arranged in the outlet side of the supply opening. In such an example, the side wall may be oriented transversely with respect to the longitudinal axis of the cylinder block.

In the cooling system embodiment described herein, where the coolant flows through the cylinder block and the cylinder head from the outlet side, it may be advantageous to arrange the supply opening on the outlet side. For example, the supply opening may be arranged on the outlet side in a side wall of the cylinder block. In such an example, the side wall is oriented transverse to the longitudinal axis of the cylinder block.

Embodiments of the supercharged, liquid-cooled internal combustion engine in which the supply opening and the discharge opening are arranged at opposite ends of the cylinder block may also be advantageous. This embodiment may ensure that there is also actually a flow through the coolant jackets and may also ensure that no relatively large dead water regions are formed in which the coolant does not flow but rather remains stagnant.

In supercharged internal combustion engines where an exhaust gas line adjoins each outlet opening of a cylinder and where an intake line adjoins each inlet opening, embodiments can be advantageous where the cylinder head is equipped with at least two integrated coolant jackets. In such an example, a lower coolant jacket may be positioned between the exhaust gas lines and the cylinder block, and an upper coolant jacket may be arranged on a side of the exhaust gas lines that faces away from the block and is opposite the lower coolant jacket.

Embodiments of the supercharged, liquid-cooled internal combustion engine may be advantageous in which the lower coolant jacket can at least be connected to the first block-associated coolant jacket for the purpose of supplying coolant and to the second block-associated coolant jacket for the purpose of discharging coolant.

In this context, embodiments of the supercharged, liquid-cooled internal combustion engine where the lower coolant jacket and the upper coolant jacket are coolant jackets that are separated from one another are likewise advantageous. Embodiments may also be advantageous where the upper coolant jacket can be connected to a pump to supply coolant via an external supply line.

In supercharged internal combustion engines of the type in question, in which the at least one cylinder head is equipped with a lower coolant jacket and an upper coolant jacket, embodiments may also be advantageous in which the lower coolant jacket encloses the at least one exhaust gas line of each cylinder around the entire circumference in certain places.

In supercharged internal combustion engines of the type in question, in which the at least one cylinder head is equipped with a lower coolant jacket and an upper coolant jacket, embodiments may also be advantageous in which the lower coolant jacket encloses the intake lines of each cylinder around the entire circumference in certain places.

Embodiments of the supercharged liquid-cooled internal combustion engine in which each cylinder has on the inlet side an inlet opening for supplying combustion air via an intake system and on the outlet side an outlet opening for discharging the exhaust gases via an exhaust-gas discharge system may also be advantageous. This embodiment may provide an internal combustion engine in which each cylinder has two openings for the gas exchange and is therefore equipped with two valves, specifically with an inlet valve and an outlet valve, in one example.

However, embodiments of the supercharged liquid-cooled internal combustion engine in which each cylinder has on the inlet side two inlet openings for supplying combustion air via the intake system and on the outlet side two outlet openings for discharging the exhaust gases via the exhaust-gas discharge system can also be advantageous. This embodiment may provide an internal combustion engine in which each cylinder has four openings for the gas exchange and is therefore equipped with four valves, in the present case with two inlet valves and two outlet valves.

It may be an objective of a valve drive to open and close the inlet and outlet openings of the combustion chamber at the correct times. It may also be desirable to rapidly open the valve drive with large flow cross-sections in order to keep the throttling losses in the inflowing and outflowing gas flows low and in order to ensure the desired charging of the combustion chamber with fresh mixture and an effective, that is to say complete, discharge of the exhaust gases. It is therefore advantageous for a cylinder to be provided with two or more inlet openings and two or more outlet openings, in some examples.

Embodiments of the supercharged, liquid-cooled internal combustion engine may also be advantageous in which each cylinder is equipped with an injection device for the direct introduction of the fuel into the cylinder. In spark-ignition engines, the direct injection can be used to dethrottle the spark-ignition-engine working method. Basically, the direct injection may serve to form a homogenous fuel/air mixture.

Embodiments of the supercharged, liquid-cooled internal combustion engine in which each cylinder is equipped with an ignition device for initiating spark ignition or with a glow plug for assisting auto-ignition can also be advantageous, in some examples.

In one example, a coolant jacket may be, if appropriate, provided in the cylinder head and has breakthroughs or cutouts through which an injection device and/or an ignition device or glow plug can extend.

FIG. 1 shows an illustration of an internal combustion engine 1 (e.g., supercharged internal combustion engine) with a liquid cooling system 100 in a side view. A longitudinal axis 102 of the engine is shown arranged perpendicularly with respect to the plane of the drawing, for reference. Additionally, FIG. 1 shows a Z-axis and an X-axis, for reference. In one example, the Z-axis may be parallel to a gravitational axis. However, other orientations of the Z-axis have been contemplated.

Figure 3:
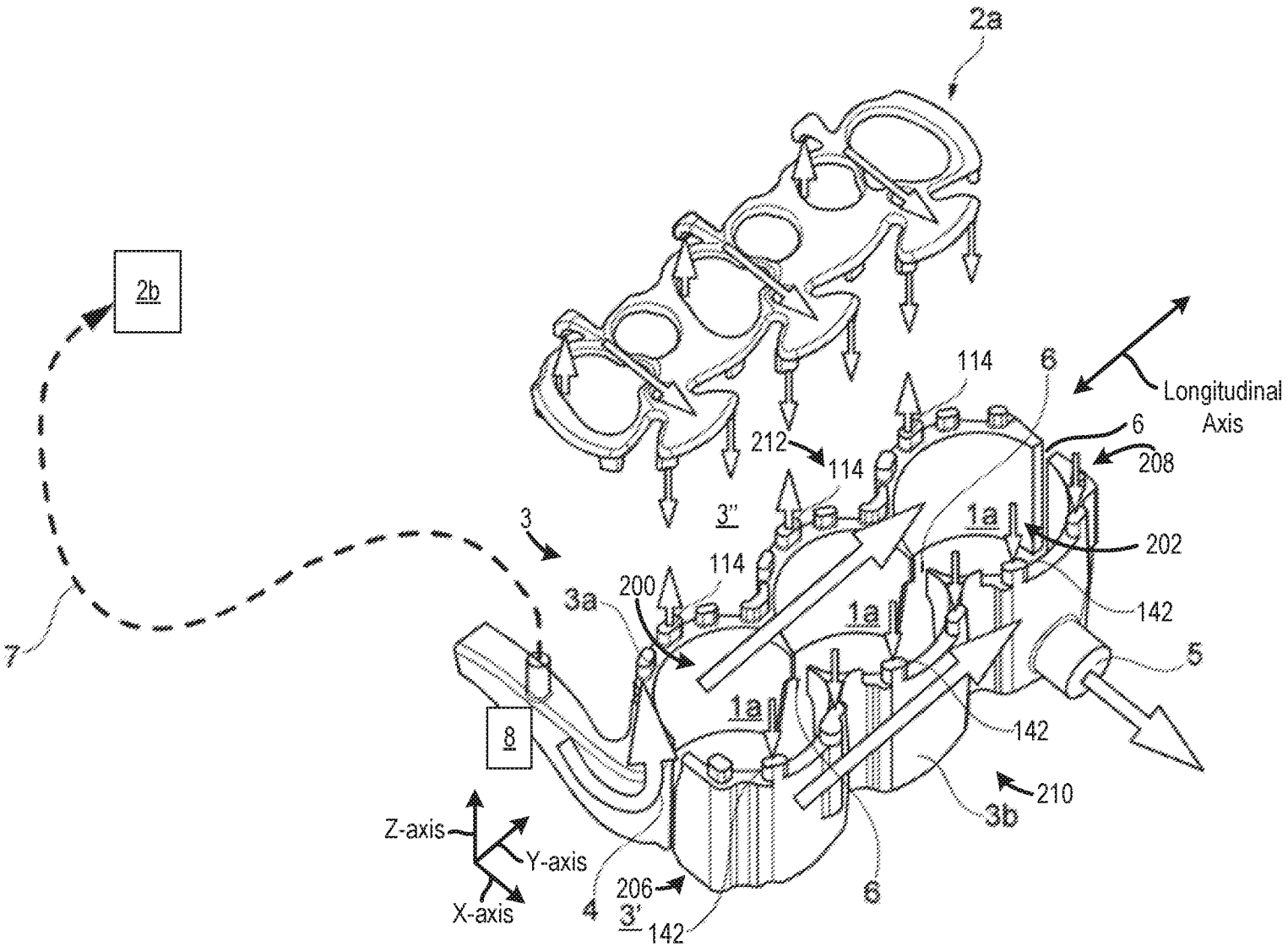
FIG. 3 shows a schematic view of coolant jackets in the liquid cooling system in the internal combustion engine according to a first embodiment.

The internal combustion engine 1 includes, for the purpose of forming a liquid cooling system 100, a liquid-cooled cylinder head 2 and a liquid-cooled cylinder block 3, which together also form the cylinders 1*a* of the internal combustion engine 1. Although only a single cylinder is shown in FIG. 1, it will be appreciated that the internal combustion engine 1 may include additional cylinders, in other examples. For instance, FIG. 3 depicts the engine with three cylinders in an inline configuration.

The liquid-cooled cylinder block 3 is equipped with two integrated coolant jackets 3*a*, 3*b*. In the illustrated example, the coolant jackets 3*a*, 3*b* are fluidically separated from one another. That is to say that coolant does not flow between the coolant jacket 3*a* and the coolant jacket 3*b* in the cylinder block 3.

In the illustrated example, the first block-associated coolant jacket 3*a* is provided on an outlet side 104 of the internal combustion engine 1. Additionally, the second block-associated coolant jacket 3*b* is provided on an inlet side 106 of the internal combustion engine 1. These two block-associated coolant jackets 3*a*, 3*b* are integrally positioned in the cylinder block 3 which may be manufactured using a casting method, in one example. For instance, the cylinder block blank, shown in FIG. 3, may be used to cast the cylinder block 3.

Continuing with FIG. 1, the first block-associated coolant jacket 3*a* has, for the purpose of supplying coolant, a supply opening 4 (e.g., inlet) which is arranged in an outlet-side side wall 3" of the cylinder block 3 and is oriented along the longitudinal axis of the cylinder block 3. The second block-associated coolant jacket 3*b* has, for the purpose of discharging the coolant, a discharge opening 5 (e.g., outlet) which is arranged in an inlet-side side wall 3'" of the cylinder block 3 that is oriented along the longitudinal axis of the cylinder block 3. In order to form a coolant circuit, the discharge opening 5 can at least be connected to the supply opening 4, wherein a pump 8 is provided in order to feed the coolant and to allow it to circulate in the circuit. Specifically, the pump 8 (e.g., coolant pump) includes an outlet 108 in fluidic communication with the supply opening 4. Further in one example, the first and second block-associated coolant jackets 3*a* and 3*b* may form a single block-associated coolant jacket with coolant conduits in the cylinder block that are spaced away from one another.

As discussed above, the cylinder head 2 is equipped with two integrated head-associated coolant jackets 2*a*, 2*b* which are fluidically separated from one another, i.e., are embodied as separate coolant jackets 2*a*, 2*b*. The lower coolant jacket 2*a* (e.g., lower head-associated coolant jacket) faces the cylinder block 3 and extends between the exhaust gas lines and the cylinder block 3. An upper coolant jacket 2*b* (e.g., upper head-associated coolant jacket) is arranged on the side of the exhaust gas lines which faces away from the cylinder block 3 and is opposite the lower head-associated coolant jacket 2*a*. As previously discussed, the lower head-associated coolant jacket 2*a* is supplied, via the first block-associated coolant jacket 3*a*, with coolant which originates from the cylinder block 3 and has been supplied to the cylinder block 3 via the supply opening 4.

Figure 2:
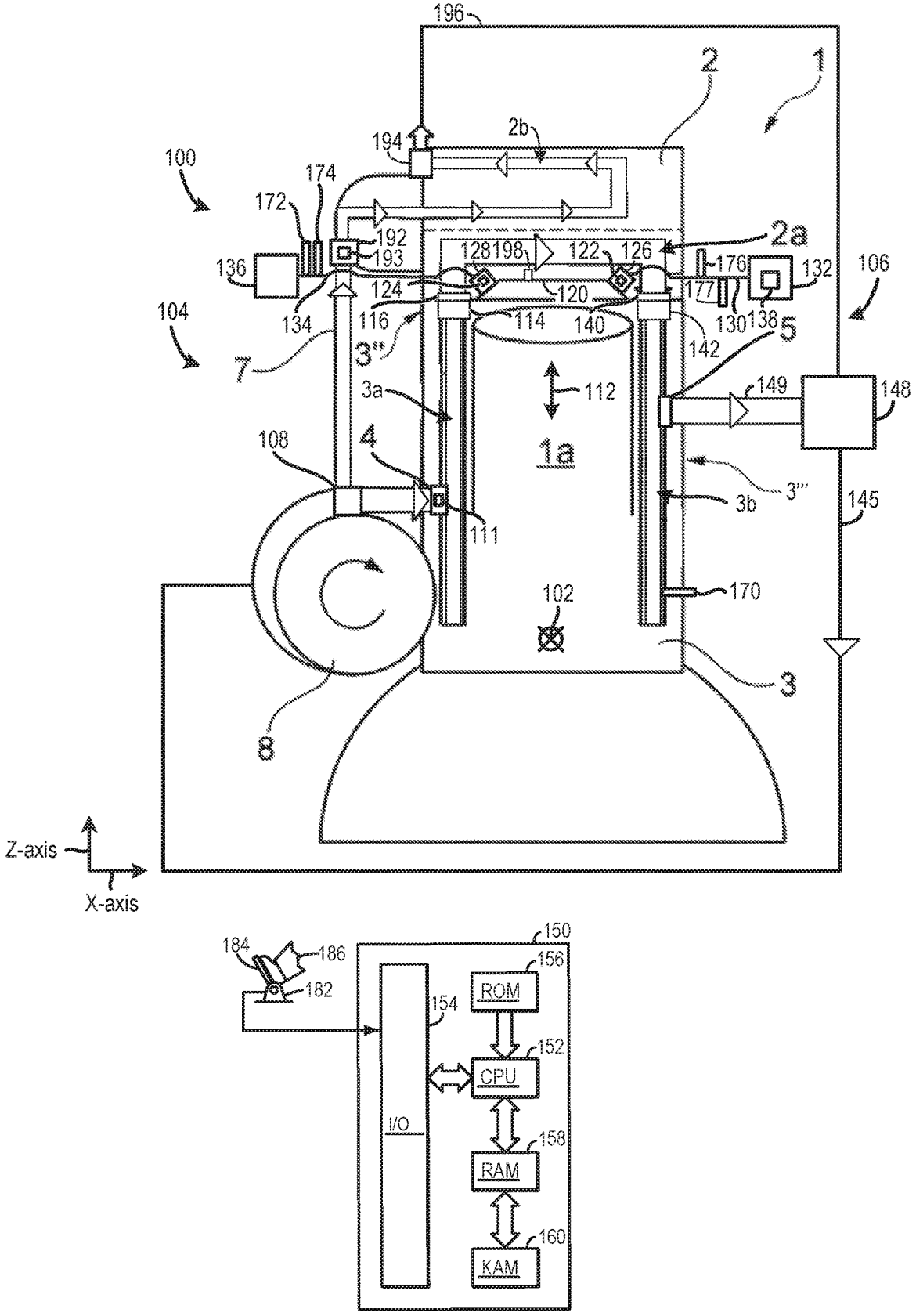
FIG. 2 shows the engine depicted in FIG. 1 with additional information regarding a vehicle liquid cooling system.

FIG. 2 shows the supply opening 4 (e.g., inlet) which opens into a coolant passage in the first block-associated coolant jacket 3*a*, thereby enabling coolant from the coolant pump 8 to flow into the coolant passage in the first block-associated coolant jacket 3*a*. The supply opening 4 may include a valve 111 regulating the amount of coolant flow into the coolant passage in the first block-associated coolant jacket 3*a*. However, in other examples, the valve 111 may be omitted from the engine 1. In the illustrated example, the coolant passage 3*a* travels in a vertical direction through the cylinder block 3. Specifically in one example, the coolant passage 3*a* may be parallel to a central axis 112 of the cylinder 1*a*. The coolant passage in the first block-associated coolant jacket 3*a* is also positioned on an outlet side of the internal combustion engine 1, in the illustrated example. However, other relative positions of the coolant passage 3*a* are contemplated. The coolant passage in the first block-associated coolant jacket 3*a* includes an outlet 114. The outlet 114 is in fluidic communication (e.g., direct fluidic communication) with an inlet 116 of a lower head-associated coolant jacket 2*a*. The inlet 116 opens into the coolant conduit of the lower head-associated coolant jacket 2*a* traversing the cylinder head 2. Specifically, at least a portion of the lower head-associated coolant jacket 2*a* may be positioned vertically above an upper wall 120 of the cylinder 1*a*, in one example. In this way, the lower head-associated coolant jacket 2*a* can remove more heat from the cylinder. Consequently, the cylinder's combustion efficiency can be increased while in turn reducing engine emissions. In this way, coolant may flow sequentially from the coolant pump 8 into the first block-associated coolant jacket 3*a* and then into the lower head-associated coolant jacket 2*a*. Thus, the first block-associated coolant jacket 3*a* is positioned upstream of the lower head-associated coolant jacket 2*a*, in such an example.

Additionally, in one example, a coolant conduit in the lower head-associated coolant jacket 2*a* extends from a position in the cylinder head 2 vertically above an inlet opening 126 having an inlet valve 122 positioned therein to a position in the cylinder head vertically above an outlet opening 128 having an outlet valve 124 positioned therein. Positioning the coolant conduit in the lower head-associated coolant jacket 2*a* in this location enables the liquid cooling system 100 to remove a greater amount of heat from the engine. Both the inlet valve 122 and the outlet valve 124 are coupled to the cylinder 1*a*. The inlet opening 126 provides the cylinder 1*a* with intake airflow while the inlet valve 122 is open and the outlet opening 128 enables combustion gas to flow out of the cylinder while the outlet valve 124 is open.

An intake conduit 130 (e.g., intake manifold) provides fluidic communication between an intake system 132 and the inlet opening 126 and correspondingly the inlet valve 122. On the other hand, an exhaust conduit 134 (e.g., exhaust manifold) provides fluidic communication between an exhaust-gas discharge system 136 and the outlet opening 128 and correspondingly the outlet valve 124. The intake system 132 includes a compressor 138 designed to increase intake air pressure and therefore provide boost to the engine 1. In one example, the exhaust-gas discharge system 136 may include a turbine rotationally coupled to the compressor. However, in other examples the compressor 138 may be driven via an electric motor or via a crankshaft. The lower head-associated coolant jacket 2*a* may include sections that at least partially circumferentially surround sections of the exhaust conduit 134 and/or the intake conduit 130. In this way, the lower-head associated coolant can extract heat from the exhaust manifold to increase engine cooling, for instance.

As discussed above, the lower head-associated coolant jacket 2*a* is connected to the first block-associated coolant jacket 3*a* for the purpose of supplying coolant. The lower head-associated coolant jacket 2*a* is also connected to the second block-associated coolant jacket 3*b* for the purpose of discharging coolant. Specifically, the lower head-associated coolant jacket 2*a* includes an outlet 140 in fluidic communication (e.g., direct fluidic communication) with an inlet 142 of the second block-associated coolant jacket 3*b*. In this way, coolant may flow back to coolant passages in the cylinder block 3 after it has traveled in a region above the cylinder 1*a*, enabling even more heat to be removed from the regions around the cylinder via the cooling system 100. The coolant flows through the lower head-associated coolant jacket 2*a* which is integrated into the cylinder head 2, may be in a transverse direction with respect to the longitudinal axis of the cylinder head 2 from the outlet side to the inlet side. Furthermore, the coolant exits the cylinder head 2 on the inlet side, wherein the coolant is discharged into the second block-associated coolant jacket 3*b*.

The second block-associated coolant jacket 3*b* includes the inlet 142 in fluidic communication with the outlet 140 of the lower head-associated coolant jacket 2*a*. The coolant passage 3*b* includes a discharge opening 5 (e.g., outlet). In one example, the discharge opening 5 is in fluidic communication with a heat exchanger 148 via a coolant passage 149. In one example, the heat exchanger 148 is in fluidic communication with the coolant pump 8 via a coolant conduit 145. In this way, a coolant circuit may be formed in the cooling system 100. In one example, the discharge opening 5 may be vertically offset from the supply opening 4. Additionally, the supply opening 4 is positioned on the outlet side 104 of the engine 1 and the discharge opening 5 is positioned on the inlet side 106 of the engine 1. However, other arrangements between the discharge opening 5 and the supply opening 4 have been contemplated.

The second block-associated coolant jacket 3*b* is shown vertically traversing the cylinder block 3 adjacent to the cylinder 1*a*. Specifically, the second block-associated coolant jacket 3*b* may be parallel to the central axis 112 of the cylinder 1*a*. However, other orientations of the second block-associated coolant jacket 3*b* have been contemplated.

Additionally, the upper head-associated coolant jacket 2*b* is connected to the pump 8 for the purpose of supplying coolant by means of an external supply line 7, which may also be integrated within the cylinder block and cylinder head. Thus, the upper head-associated coolant jacket 2*b* is in fluidic communication with the outlet 108 of the coolant pump 8. However, in other examples the coolant pump 8 may include two outlets separately supplying coolant to the upper head-associated coolant jacket 2*b* and the first block-associated coolant jacket.

The upper head-associated coolant jacket 2*b* includes a coolant passage traversing the cylinder head 2. A coolant passage in the upper head-associated coolant jacket 2*b* includes an inlet 192 receiving coolant from the coolant pump 8 and an outlet 194 supplying coolant to a coolant passage 196, which may provide coolant to the heat exchanger 148, in one example. The inlet 192 may include a valve 193 for regulating the amount of coolant flowing into the upper head-associated coolant jacket 2*b*. However, in other examples, coolant from the upper head-associated coolant jacket 2*b* may be delivered to a separate heat exchanger. The coolant passage in the upper head-associated coolant jacket 2*b* is positioned vertically above the coolant conduit in the upper head-associated coolant jacket 2*a*. Additionally, the coolant passage in the upper head-associated coolant jacket 2*b* includes sections that extend across the cylinder head 2 from the outlet side 104 of the engine 1 to the inlet side 106 of the engine and vice versa. Additionally, the coolant passage in the upper head-associated coolant jacket 2*b* includes a section that extends vertically through the cylinder head 2.

Further, in the depicted example, the upper head-associated coolant jacket 2*b* is fluidly separated from the lower head-associated coolant jacket 2*a*. That is to say, that coolant does not flow between the upper and lower head-associated coolant jackets at locations in the cylinder head. However, in other instances the head-associated coolant jackets may be in fluidic communication within the block-associated coolant jackets.

FIG. 2 also shows a fuel injector 198 coupled to the cylinder 1*a*. The fuel injector 198 may receive fuel from a fuel delivery system (now shown). Additionally or alternatively, a port fuel injector may provide fuel to the cylinder 1*a*. It will be appreciated that the fuel delivery system may include a fuel storage device, pumps, valves, etc., for supplying injectors with fuel.

FIG. 2 also shows a controller 150. Specifically, controller 150 is shown in FIG. 2 as a conventional microcomputer including: microprocessor unit 152, input/output ports 154, read-only memory 156, random access memory 158, keep alive memory 160, and a conventional data bus. Controller 150 is configured to receive various signals from sensors coupled to the engine 1. The sensors may include engine coolant temperature sensor 170, exhaust gas composition sensor 172, exhaust gas airflow sensor 174, an intake airflow sensor 176, manifold pressure sensor 177, etc. Additionally, the controller 150 is also configured to receive throttle position (TP) from a throttle position sensor 182 coupled to a pedal 184 actuated by an operator 186.

Additionally, the controller 150 may be configured to trigger one or more actuators and/or send commands to components. For instance, the controller 150 may trigger adjustment of the pump 8, the valve 111, the valve 193, etc. Specifically, the controller 150 may be configured to send signals to the pump 8 and/or the valve 111 to regulate the amount of coolant flowing into the coolant conduits in the cylinder block 3 and/or the cylinder head 2. The controller 150 may also be configured to send control signals to the valve 193 to regulate the amount of coolant flowing through the upper head-associated coolant jacket 2*b*. The controller 150 may also be configured to send control signals to the intake system 132 (e.g., a throttle in the intake system) to vary engine speed. Furthermore, the controller 150 may be configured to send control signals to the fuel injector 198 and/or a fuel pump (not shown) to control the amount and timing of fuel injection provided to the cylinder 1*a*. Therefore, the controller 150 receives signals from the various sensors and employs the various actuators to adjust engine operation based on the received signals and instructions stored in memory (e.g., non-transitory memory) of the controller. Thus, it will be appreciated that the controller 150 may send and receive signals from the cooling system 100. For example, the pump 8 and/or the valve 111 may include device actuators to adjust components in the pump and/or the valve to vary coolant flow provided to the cylinder block and cylinder head. In some examples, the pump 8 may independently regulate the amount of coolant flow provided to the upper head-associated coolant jacket 2*b* and the first block-associated coolant jacket 3*a*. In this way, coolant flow in different portions of the engine may be precisely tuned to achieve variable cooling needs in the engine, if desired.

FIG. 3 shows a perspective view of the coolant jackets 2*a*, 2*b*, 3*a*, 3*b* of the liquid cooling system 100 in a first embodiment of the internal combustion engine 1. The liquid cooling system 100 shown in FIG. 3 may be implemented in a way complimentary to FIGS. 1 and 2, with the differences also being presented. Therefore, the same reference signs have been used for the same components. An X-axis, Y-axis, and Z-axis are also provided in FIG. 3, for reference.

FIG. 3 also shows the supply opening 4 of the first block-associated coolant jacket 3*a* adjacent to a first cylinder 200 (e.g., a first peripheral cylinder) and the discharge opening 5 of the second block-associated coolant jacket 3*b* adjacent to a second cylinder 202 (e.g., a second peripheral cylinder). Positioning the supply and discharge openings in this way enables a coolant flow pattern to be generated in the cylinder block that increases the amount of heat removed from the block via the cooling system. The first cylinder 200 is positioned at a first end 206 of the cylinder block 3 and the second cylinder 202 is positioned at a second end 208 of the cylinder block. An inlet side 210 and an outlet side 212 of the cylinder block 3 are also shown in FIG. 3. It will be appreciated that coolant flows from the outlet side 212 of the cylinder block to the inlet side 210 in the lower head-associated coolant jacket 2*a*. Additionally, coolant is shown flowing in a direction from the first end 206 of the cylinder block 3 to the second end of the cylinder block in both of the first block-associated coolant jacket 3*a* and the second block-associated coolant jacket 3*b*.

The illustration shows the coolant jackets 2*a*, 2*b*, 3*a*, 3*b* of a three-cylinder series-mounted engine in which each cylinder 1*a* has an inlet opening for supplying combustion air via the intake system and an outlet opening for discharging the exhaust gases via an exhaust gas discharge system. The lower head-associated coolant jacket 2*a* encloses the entire circumference of the exhaust gas lines which connect to the outlet openings, and the intake lines which lead to the inlet openings, in one example. However, other lower head-associated jacket contours have been contemplated.

The main flow direction of the coolant in the cylinder head 2 runs transversely with respect to the longitudinal axis of the cylinder head 2, with the result that short flow paths for the coolant are produced in the cylinder head 2. The coolant flows, driven by the pressure gradient between the first block-associated coolant jacket 3*a* and the second block-associated coolant jacket 3*b*, from the thermally highly stressed outlet side to the thermally less stressed inlet side. In this context, the coolant flows over the thermally highly stressed region of the cylinder head 2 which faces the cylinder block 3. Here, the coolant flows between the openings of the cylinders 1*a*, from the outlet side to the inlet side. The flow rate and therefore the discharge of heat owing to convection can be influenced via the flow cross-sections, which are made available.

Since a pressure gradient may not occur along the longitudinal axis of the cylinder head 2, the outlet (e.g., outlet-side connecting duct) 114 and the inlet (e.g., inlet-side connecting duct) 142, which connect the lower head-associated coolant jacket 2*a* to the block-associated coolant jackets 3*a* 3*b*, can be provided, i.e., embodied with equally large diameters.

In the embodiment illustrated in FIG. 3, the supply opening 4 is arranged on the outer side in a side wall 3" of the cylinder block 3 and the side wall 3" is oriented transversely with respect to the longitudinal axis of the cylinder block 3, i.e., in one of the two narrow end sides 3' of the block 3.

In such an example, the flowing or feeding of the coolant from the inlet side to the outlet side in order to supply the lower head-associated coolant jacket 2*a*, integrated into the cylinder head 2, with coolant may not have to involve accepting a pressure loss, if desired.

Nevertheless, in the embodiment illustrated in FIG. 3, ducts 6 may be added by machining which fluidically connect the first block-associated coolant jacket 3*a* and the second block-associated coolant jacket 3*b* to one another.

In one example, the ducts 6 may be subsequently formed in the cylinder block blank, for example by means of drilling or sawing.

Ducts 6 of the type in question, which fluidically connect the first block-associated coolant jacket 3*a* to the second block-associated coolant jacket 3*b* in the interior of the cylinder block 3, serve for cooling the thermally highly stressed web regions between two adjacent cylinders 1*a*. However, in other examples, the cylinder block 3 may not include the ducts 6.

The coolant throughput rate through the cylinder head 2 can also be set (e.g., calibrated) using the ducts 6, in one example. This may be accomplished by selecting a number of ducts 6 with desired diameters.

FIGS. 1, 2, and 3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. In yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention will be further described in the following paragraphs. In one aspect, a supercharged internal combustion engine is provided that includes a liquid-cooled cylinder head, and a liquid-cooled cylinder block coupled to the liquid-cooled cylinder head to form a first cylinder in the supercharged internal combustion engine, where the first cylinder has on an inlet side an inlet opening supplying combustion air via an intake system and on an outlet side an outlet opening for discharging exhaust gases via an exhaust-gas discharge system, where the liquid-cooled cylinder block is equipped with two integrated coolant jackets, where a first block-associated coolant jacket is provided on the outlet side and has a supply opening for supplying coolant to the first block-associated coolant jacket, and a second block-associated coolant jacket is provided on the inlet side and has a discharge opening for discharging the coolant, where the liquid-cooled cylinder head is equipped with an integrated head-associated coolant jacket that is connected to the first block-associated coolant jacket and supplies coolant and to the second block-associated coolant jacket for the purpose of discharging the coolant, where the first block-associated coolant jacket and the second block-associated coolant jacket are each positioned integrally in the liquid-cooled cylinder block, and where the first block-associated coolant jacket and the second block-associated coolant jacket of a cylinder block blank are fluidically separated from one another.

In another aspect, an internal combustion engine is provided that includes a cylinder head coupled to a cylinder block to form a first cylinder, an upper head-associated coolant jacket including a coolant conduit traversing the cylinder head, a lower head-associated coolant jacket fluidly separated from the upper head-associated coolant jacket and including a coolant conduit traversing the cylinder head vertically below the upper head-associated coolant jacket, and a block-associated coolant jacket including, a first coolant passage having an inlet in fluidic communication with a coolant pump outlet and an outlet in fluidic communication with an inlet of the lower head-associated coolant jacket, and a second coolant passage having an inlet in fluidic communication with an outlet of the lower head-associated coolant jacket and an outlet in fluidic communication with a heat exchanger or a thermostat valve.

In any of the aspects of combinations of the aspects, the discharge opening may be connected to the supply opening to form a coolant circuit.

In any of the aspects of combinations of the aspects, the first block-associated coolant jacket and the second block-associated coolant jacket may be fluidically connected to one another via a duct which is formed in the cylinder block blank.

In any of the aspects of combinations of the aspects, the duct may be a machined duct.

In any of the aspects of combinations of the aspects, the internal combustion engine may further include a second cylinder adjacent to the first cylinder, where the duct may be arranged and led between the first cylinder and the second cylinder.

In any of the aspects of combinations of the aspects, where the duct may have a maximum diameter $d_{k,max}$ where $d_{k,max} \leq 5$ mm or a maximum saw kerf width $s_{k,max}$ where $s_{k,max} \leq 4$ mm.

In any of the aspects of combinations of the aspects, the internal combustion engine may further include a second cylinder, where the first and second cylinders are arranged along a longitudinal axis of the cylinder block and where on the inlet side the discharge opening is arranged in a side wall of the cylinder block, which side wall is oriented parallel to the longitudinal axis of the cylinder block.

In any of the aspects of combinations of the aspects, the internal combustion engine may further include a second cylinder, where the first and second cylinders are arranged along a longitudinal axis of the cylinder block and where on the outlet side the supply opening is arranged in a side wall of the cylinder block, which side wall is oriented transversely with respect to the longitudinal axis of the cylinder block.

In any of the aspects of combinations of the aspects, the supply opening and the discharge opening may be arranged at opposite ends of the cylinder block.

In any of the aspects of combinations of the aspects, the internal combustion engine may further include an exhaust gas line adjoining the outlet opening of a cylinder, and an intake line adjoining the inlet opening, where the integrated head-associated coolant jacket is a lower coolant jacket and the liquid-cooled cylinder head further includes one or more upper coolant jackets spaced away from the lower coolant jacket.

In any of the aspects of combinations of the aspects, the lower coolant jacket may be connected to the first block-associated coolant jacket for the purpose of supplying coolant, and to the second block-associated coolant jacket for the purpose of discharging coolant.

In any of the aspects of combinations of the aspects, the lower coolant jacket and the upper coolant jacket may be coolant jackets that are separated from one another.

In any of the aspects of combinations of the aspects, the upper coolant jacket may be connected to a pump supplying coolant to the upper coolant jacket via an external supply line.

In any of the aspects of combinations of the aspects, the lower coolant jacket may enclose the exhaust gas line around an entire circumference of the exhaust gas line in a selected location.

In any of the aspects of combinations of the aspects, the lower coolant jacket may enclose the intake line around an entire circumference of the exhaust gas line in a selected location.

In any of the aspects of combinations of the aspects, at least a portion of the lower head-associated coolant jacket may be positioned vertically above an upper wall of the first cylinder.

In any of the aspects of combinations of the aspects, the inlet of the block-associated coolant jacket in fluidic communication with the pump and the outlet of the block-associated coolant jacket in fluidic communication with the heat exchanger or thermostat valve may be positioned on opposing sides of the first cylinder.

In any of the aspects of combinations of the aspects, the coolant conduit in the lower head-associated coolant jacket may extend from a position in the cylinder head vertically above an inlet opening of the first cylinder to a position in the cylinder head vertically above an outlet opening of the first cylinder.

In any of the aspects of combinations of the aspects, the inlet in the first coolant passage of the block-associated coolant jacket may be positioned adjacent to the first cylinder and the outlet of the second coolant passage in the block-associated coolant jacket is positioned adjacent to a second cylinder.

In any of the aspects of combinations of the aspects, each cylinder may have on the inlet side an inlet opening for supplying combustion air via the intake system, and on the outlet side an outlet opening for discharging the exhaust gases via an exhaust-gas discharge system.

In any of the aspects of combinations of the aspects, each cylinder may have on the inlet side two inlet openings for supplying combustion air via the intake system and on the outlet side two outlet openings for discharging the exhaust gases via the exhaust-gas discharge system.

In any of the aspects of combinations of the aspects, each cylinder may be equipped with an injection device for the direct introduction of the fuel into the cylinder.

It will be appreciated that the configurations and routines disclosed herein are exemplary in nature, and that these specific embodiments are not to be considered in a limiting sense, because numerous variations are possible. For example, the above technology can be applied to other types of engines (V-6, I-4, I-6, V-12, opposed 4, etc.), vehicle systems, etc. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

It will further be appreciated by those skilled in the art that although the invention has been described by way of example with reference to several embodiments it is not limited to the disclosed embodiments and that alternative embodiments could be constructed without departing from the scope of the invention as defined in the appended claims.

The invention claimed is:

1. A supercharged internal combustion engine comprising:

a cylinder head; and a cylinder block coupled to the cylinder head to form a first cylinder in the supercharged internal combustion engine;

where the first cylinder has on an inlet side an inlet opening supplying combustion air via an intake system and on an outlet side an outlet opening for discharging exhaust gases via an exhaust-gas discharge system;

where the cylinder block is equipped with two integrated coolant jackets, where a first block coolant jacket is provided on the outlet side and has a supply opening for supplying coolant to the first block coolant jacket, and a second block coolant jacket is provided on the inlet side and has a discharge opening for discharging the coolant;

where the cylinder head is equipped with an integrated head coolant jacket comprising an upper cylinder head jacket and a lower cylinder head jacket not connected to one another within the cylinder head;

where a coolant pump provides independent coolant supply to the upper cylinder head jacket and to the lower cylinder head jacket;

where the lower cylinder head jacket is connected to the first block coolant jacket to supply coolant and to the second block coolant jacket for the purpose of discharging the coolant;

where the first block coolant jacket and the second block coolant jacket are each positioned integrally in the cylinder block; and where the first block coolant jacket and the second block coolant jacket of a cylinder block blank are discrete and separate passages and are not connected to one another within the cylinder block.

2. The supercharged internal combustion engine of claim 1, wherein the supply opening is arranged in a side wall of the cylinder block and is connected to the coolant pump, and an upper cylinder head jacket supply line provides coolant flow to the upper cylinder head jacket independent from the lower cylinder head jacket.

3. The supercharged internal combustion engine of claim 1, further comprising a first valve controlling flow through the supply opening of the first block coolant jacket and a second valve controlling flow to the upper cylinder head jacket.

4. The supercharged internal combustion engine of claim 2, where a lower cylinder head coolant jacket only receives coolant from the first block coolant jacket, and the second block coolant jacket only receives coolant from the lower cylinder head coolant jacket.

5. The supercharged internal combustion engine of claim 1, where the upper cylinder head jacket is connected to the coolant pump via an external supply line receiving coolant flow independent from the first block coolant jacket and lower cylinder head jacket.

6. The supercharged internal combustion engine of claim 1, where the lower cylinder head jacket encloses an exhaust gas line around an entire circumference of the exhaust gas line in a selected location.

7. The supercharged internal combustion engine of claim 1, where the lower cylinder head jacket encloses an intake line around an entire circumference of the intake line in a selected location.

8. The supercharged internal combustion engine of claim 1, wherein the coolant pump is a variable to independently regulate the amount of coolant flow to an upper cylinder head jacket and the first block coolant jacket.

9. The supercharged internal combustion engine of claim 8, wherein the coolant pump is electric.

10. An internal combustion engine comprising:

a cylinder head coupled to a cylinder block to form a first cylinder;

an upper head coolant jacket including a coolant conduit traversing the cylinder head;

a lower head coolant jacket discrete and separate from the upper head coolant jacket and not connected to the upper head coolant jacket within the cylinder head, the lower head coolant jacket including a coolant conduit traversing the cylinder head vertically below the upper head coolant jacket; and a block coolant jacket including;

a first coolant passage having an inlet in fluidic communication with a coolant pump outlet and an outlet in fluidic communication with an inlet of the lower head coolant jacket;

a second coolant passage having an inlet in fluidic communication with an outlet of the lower head coolant jacket and an outlet in fluidic communication with a heat exchanger, and the second coolant passage is only connected to the first coolant passage via the lower head coolant jacket; and a coolant pump providing separate and independent flow to the lower head coolant jacket and to the upper head coolant jacket.

11. The internal combustion engine of claim 10, where at least a portion of the lower head coolant jacket is positioned vertically above an upper wall of the first cylinder and the lower head coolant jacket is a coolant connection between the first and second coolant passages of the block coolant jacket.

12. The internal combustion engine of claim 10, the coolant conduit in the lower head coolant jacket extends from a position in the cylinder head vertically above an inlet opening of the first cylinder to a position in the cylinder head vertically above an outlet opening of the first cylinder.

13. The internal combustion engine of claim 10, where the inlet in the first coolant passage of the block coolant jacket is positioned adjacent to the first cylinder and the outlet of the second coolant passage in the block coolant jacket is positioned adjacent to a second cylinder and no passages extend through webs between cylinders to connect the first and the second coolant passages in the block coolant jacket.

14. The internal combustion engine of claim 10, wherein the coolant pump is an electric coolant pump variable to independently regulate an amount of coolant flow to the upper head coolant jacket and the first coolant passage of the cylinder block coolant jacket.

15. An internal combustion engine comprising:

a cylinder head coupled to a cylinder block to form a first cylinder;

an upper cylinder head coolant jacket and a lower cylinder head coolant jacket not connected to one another within the cylinder head;

a first cylinder block coolant jacket positioned on a same side of the engine as exhaust passages of the first cylinder, and the first cylinder block coolant jacket comprising an inlet for receiving coolant from a coolant pump and an outlet for outputting coolant into the lower cylinder head coolant jacket; and a second cylinder block coolant jacket distinct and fluidly separated from the first cylinder block coolant jacket such that coolant does not flow between the first and second cylinder block coolant jackets within the cylinder block, and the second cylinder block coolant jacket comprising an inlet for receiving coolant from the lower cylinder head coolant jacket and an outlet a coolant pump providing separate and independent flow to the upper cylinder head coolant jacket and to lower cylinder head coolant jacket, coolant provided to the lower cylinder head coolant jacket via the first cylinder block coolant jacket.

16. The internal combustion engine of claim 15, wherein the first cylinder block coolant jacket and the second cylinder block coolant jacket are not connected to one another by passages through webs between cylinders.

17. The internal combustion engine of claim 15, wherein the only coolant connection between the first cylinder block coolant jacket and the second cylinder block coolant jacket is the lower cylinder head coolant jacket.

18. The internal combustion engine of claim 15, wherein the upper cylinder head coolant jacket comprises passages traversing the cylinder head and passages extending in a direction of a central axis of a cylinder.

19. The internal combustion engine of claim 15, wherein the upper cylinder head coolant jacket is above the lower cylinder head coolant jacket in a direction of a central axis of a cylinder.

20. The internal combustion engine of claim 15, wherein the coolant pump is an electric variable coolant pump and a first valve and a second valve independently regulate an amount of coolant flow to the upper cylinder head coolant jacket and the first cylinder block coolant jacket.

* * * * *